US009581410B1

(12) United States Patent
Chang et al.

(10) Patent No.: US 9,581,410 B1
(45) Date of Patent: Feb. 28, 2017

(54) PROJECTILE LAUNCHER AND METHOD OF OPERATING THE SAME

(71) Applicant: Mattel, Inc., El Sugundo, CA (US)

(72) Inventors: Kin Fai Chang, Kowloon (HK); Chun Wing Wong, Kowloon (HK); Ho Man Lau, Wan Chai (HK)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 14/622,227

(22) Filed: Feb. 13, 2015

Related U.S. Application Data

(60) Provisional application No. 61/940,034, filed on Feb. 14, 2014.

(51) Int. Cl.

| | |
|---|---|
| ***F41B 11/00*** | (2013.01) |
| ***F41B 7/08*** | (2006.01) |
| ***F41B 11/89*** | (2013.01) |
| ***A63H 33/00*** | (2006.01) |
| ***F41B 11/642*** | (2013.01) |
| *F41B 7/00* | (2006.01) |

(52) U.S. Cl.
CPC ..... *F41B 7/08* (2013.01); *A63H 33/00* (2013.01); *F41B 11/642* (2013.01); *F41B 11/89* (2013.01); *F41B 7/003* (2013.01)

(58) Field of Classification Search
CPC F41B 11/89; F41B 7/08; F41B 11/642; F41B 7/003; A63H 33/00
USPC ..... 124/16, 27, 66; 446/473; 42/54
See application file for complete search history.

(56) References Cited

U.S. PATENT DOCUMENTS

| | | | | | |
|---|---|---|---|---|---|
| 2,580,356 | A * | 12/1951 | Martin | F41B 11/642 | 124/31 |
| 2,713,338 | A * | 7/1955 | Abagoff | F41B 7/006 | 124/27 |
| 2,749,902 | A * | 6/1956 | Foster | F41B 11/50 | 124/44.7 |
| 2,938,512 | A * | 5/1960 | Smolen | F41B 9/004 | 124/16 |
| 3,262,440 | A * | 7/1966 | Kuhn | F41B 11/51 | 124/53 |
| 3,339,536 | A * | 9/1967 | Glass | A63H 5/04 | 124/29 |
| 3,765,396 | A * | 10/1973 | Kienholz | F41B 11/50 | 124/44.7 |

(Continued)

*Primary Examiner* — Alexander Niconovich
(74) *Attorney, Agent, or Firm* — Edell, Shapiro & Finnan, LLC

(57) ABSTRACT

A toy configured to operate in two modes of operation wherein projectiles are launched from different portions of the toy depending upon which mode of operation the toy is in, the toy having: a housing with a forward pistol grip portion and a rearward pistol grip portion, the rearward pistol grip portion being movably mounted to the housing for movement between a first position to a second position; a mode selector switch movably mounted to the housing for movement from a first position to a second position; wherein movement of the rearward pistol grip portion between the first position and the second position launches a projectile from one portion of the toy when the mode selector switch is in the first position; and wherein movement of the rearward pistol grip portion between the first position and the second position launches a projectile from another portion of the toy when the mode selector switch is in the second position.

20 Claims, 12 Drawing Sheets

(56) References Cited

U.S. PATENT DOCUMENTS 4,241,716 A * 12/1980 Tsui ..... F41B 7/006 124/27
4,625,706 A 12/1986 Turner, Jr.
4,732,136 A * 3/1988 Ferri ..... F41B 11/646 124/67
4,750,895 A 6/1988 Shinohara
4,848,307 A 7/1989 Tsao
4,864,759 A 9/1989 Ferri
5,261,852 A 11/1993 Ejima
5,283,970 A 2/1994 Aigner
5,323,755 A 6/1994 Hsieh
5,359,985 A * 11/1994 Schumacher ..... F41B 11/642 124/1
5,373,832 A * 12/1994 D'Andrade ..... F41B 11/68 124/59
5,373,833 A 12/1994 D'Andrade
5,377,655 A 1/1995 Arad
5,448,984 A * 9/1995 Brovelli ..... F41B 11/00 124/69
5,522,374 A 6/1996 Clayton
5,531,210 A 7/1996 Meiser et al.
5,535,729 A 7/1996 Griffin et al.
5,605,140 A * 2/1997 Griffin ..... F41B 11/642 124/59
5,645,038 A 7/1997 Luk
5,653,215 A 8/1997 Chung et al.
5,680,853 A * 10/1997 Clayton ..... F41B 11/54 124/59
5,699,781 A * 12/1997 Johnson ..... F41B 11/681 124/59
5,711,285 A * 1/1998 Stewart ..... F41B 11/642 124/67
5,738,079 A * 4/1998 Keller ..... F41B 11/642 124/66
5,791,326 A * 8/1998 Brown ..... F41B 11/642 124/66
5,797,385 A * 8/1998 Thai ..... F41B 11/89 124/59
5,924,413 A * 7/1999 Johnson ..... F41B 11/54 124/72
5,975,068 A * 11/1999 Halter ..... F41B 11/642 124/37
5,988,152 A 11/1999 Halter et al.
6,067,975 A * 5/2000 Ginn ..... F41B 11/89 124/59
6,076,511 A 6/2000 Grimm
6,151,824 A 11/2000 Clayton
6,364,162 B1 * 4/2002 Johnson ..... F41B 9/0018 222/61
6,648,726 B2 11/2003 Hornsby
6,824,442 B2 * 11/2004 Andrews ..... A63H 30/04 446/175
7,156,085 B2 1/2007 Lewis
7,185,787 B2 * 3/2007 Brown ..... F41B 9/0012 222/79
7,267,118 B2 * 9/2007 Eddins ..... F41B 9/0012 124/59
7,287,526 B1 10/2007 Bligh et al.
7,305,980 B2 12/2007 Liao
7,349,153 B2 3/2008 Rosenblum
7,481,209 B1 1/2009 Bligh et al.
7,677,232 B2 * 3/2010 Rosenblum ..... F41A 21/06 124/16
7,677,235 B2 * 3/2010 Zimmerman ..... F41B 11/646 102/502
7,686,003 B2 * 3/2010 Witzigreuter ..... A61M 25/0618 124/65
7,731,061 B1 * 6/2010 Woodhouse ..... A45F 5/00 124/56
7,946,283 B2 5/2011 Lee et al.
7,975,682 B2 7/2011 Yang
8,118,637 B2 * 2/2012 De La Torre ..... A63H 33/003 446/473
8,127,753 B1 3/2012 Brooks et al.
8,127,754 B1 * 3/2012 Johnson ..... F41A 21/06 124/66
8,146,579 B2 4/2012 Jablonski et al.
8,186,337 B2 * 5/2012 Nadel ..... F41A 11/02 124/63
8,336,531 B2 12/2012 Fan et al.
8,353,277 B2 1/2013 Huebl
8,387,605 B2 3/2013 Brown et al.
8,402,956 B2 3/2013 Dakan et al.
8,448,365 B2 * 5/2013 Mead ..... F41B 7/003 42/54
8,578,915 B2 * 11/2013 Sopinsky ..... F41A 19/02 124/16
8,671,926 B1 * 3/2014 Mahlstedt ..... F41B 11/89 124/65
8,998,673 B2 * 4/2015 Martinez ..... F41B 3/04 124/16
2007/0034197 A1 * 2/2007 Tschech ..... F41B 11/641 124/65
2008/0022990 A1 * 1/2008 Mitchell ..... F41B 11/641 124/65
2010/0041310 A1 * 2/2010 Torre ..... A63H 33/003 446/473
2011/0000473 A1 1/2011 Perron
2011/0168150 A1 * 7/2011 Fan ..... A63H 33/003 124/65
2012/0024278 A1 2/2012 Carlson et al.
2012/0080019 A1 * 4/2012 Victor ..... F41B 7/003 124/16
2012/0178338 A1 7/2012 Mowbray

* cited by examiner

PROJECTILE LAUNCHER AND METHOD OF OPERATING THE SAME

CROSS REFERENCE TO RELATED APPLICATIONS

This application claims the benefit of U.S. Provisional Patent Application Ser. No. 61/940,034, filed Feb. 14, 2014, the entire contents of which are incorporated herein by reference thereto.

BACKGROUND

Various embodiments of the present invention relate to a toy projectile launcher or dart launching mechanism and a method of operating the same.

Darts or toy projectiles have been used in toys to provide an enhanced play factor to the toys.

Accordingly, it is desirable to provide a toy projectile launcher that has various modes of operation.

SUMMARY OF THE INVENTION

In one embodiment, a toy is provided. The toy being configured to operate in two modes of operation wherein projectiles are launched from different portions of the toy depending upon which mode of operation the toy is in, the toy having: a housing with a forward pistol grip portion and a rearward pistol grip portion, the rearward pistol grip portion being movably mounted to the housing for movement between a first position and a second position; a mode selector switch movably mounted to the housing for movement from a first position to a second position; wherein movement of the rearward pistol grip portion between the first position and the second position launches a projectile from one portion of the toy when the mode selector switch is in the first position; and wherein movement of the rearward pistol grip portion between the first position and the second position launches a projectile from another portion of the toy when the mode selector switch is in the second position.

In another embodiment, a toy is provided. The toy having: a housing; a forward pistol grip portion and a rearward pistol grip portion, the rearward pistol grip portion being movably mounted to the housing for movement between a first position and a second position; a mode selector switch movably mounted to the housing for movement from a first position to a second position; wherein movement of the rearward pistol grip portion between the first position and the second position launches a projectile from housing when the mode selector switch is in the first position; and wherein movement of the rearward pistol grip portion between the first position and the second position launches a projectile from a deployable projectile launcher movably secured to the housing when the mode selector switch is in the second position.

In yet another embodiment, a method of transitioning a toy between two modes of operation wherein projectiles are launched from different portions of the toy depending upon which mode of operation the toy is in. The method including the steps of: moving a rearward pistol grip portion between a first position and a second position with respect to a housing; moving a mode selector movably mounted to the housing between a first position and a second position; wherein movement of the rearward pistol grip portion between the first position and the second position launches a projectile from one portion of the toy when the mode selector switch is in the first position; and wherein movement of the rearward pistol grip portion between the first position and the second position launches a projectile from another portion of the toy when the mode selector switch is in the second position, wherein the another portion of the toy deploys from the housing when the mode selector switch is in the first position and the rearward pistol grip portion is moved between the first position and the second position.

BRIEF DESCRIPTION OF THE DRAWINGS

These and/or other features, aspects, and advantages of the present invention will become better understood when the following detailed description is read with reference to the accompanying drawings in which like characters represent like parts throughout the drawings, wherein.

Figure 1A:
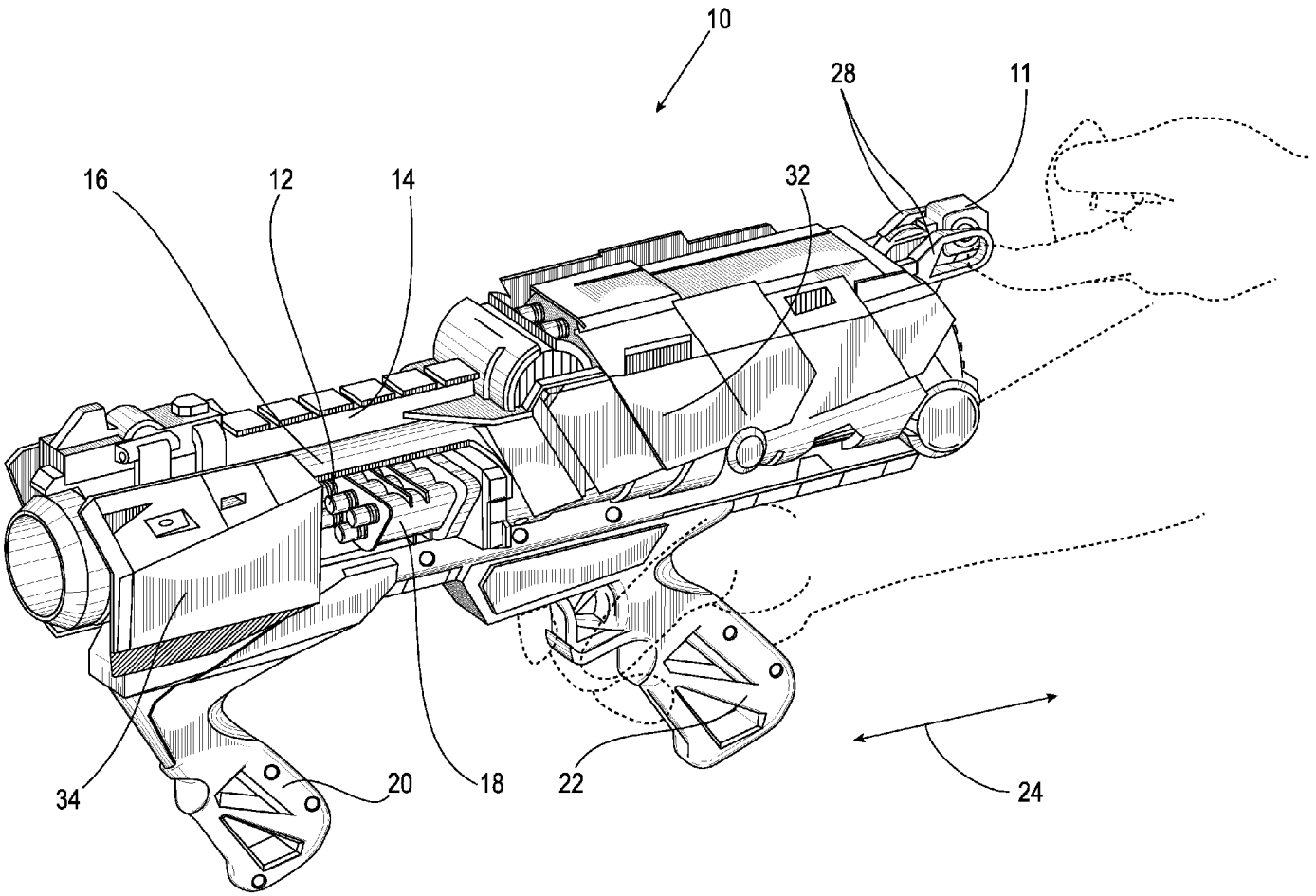
FIG. 1A is a perspective view of a device for launching a dart or projectile configured for operation in a first mode.
Figure 1B:
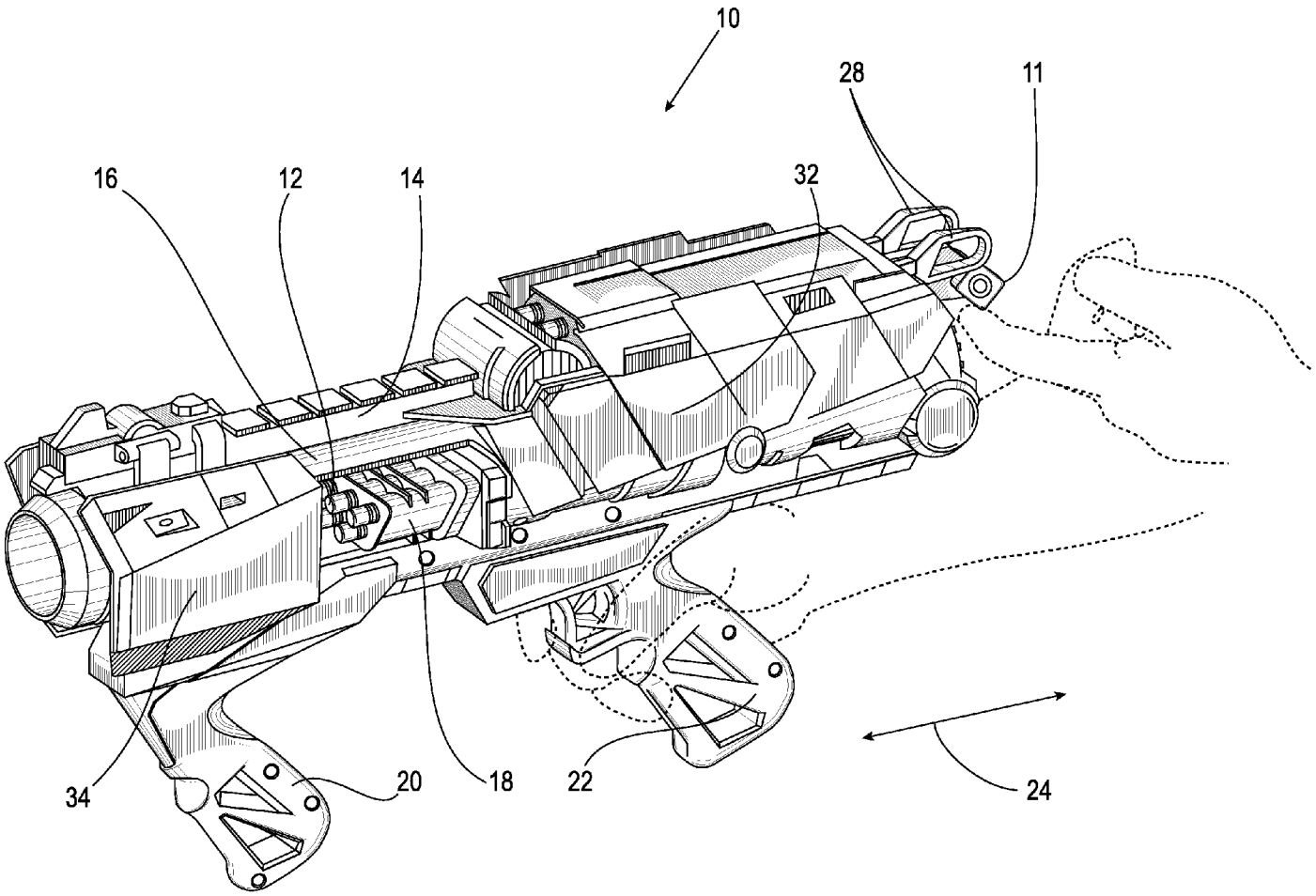
FIG. 1B is a perspective view of the device illustrated in FIG. 1A configured for operation in a second mode.
Figure 2A:
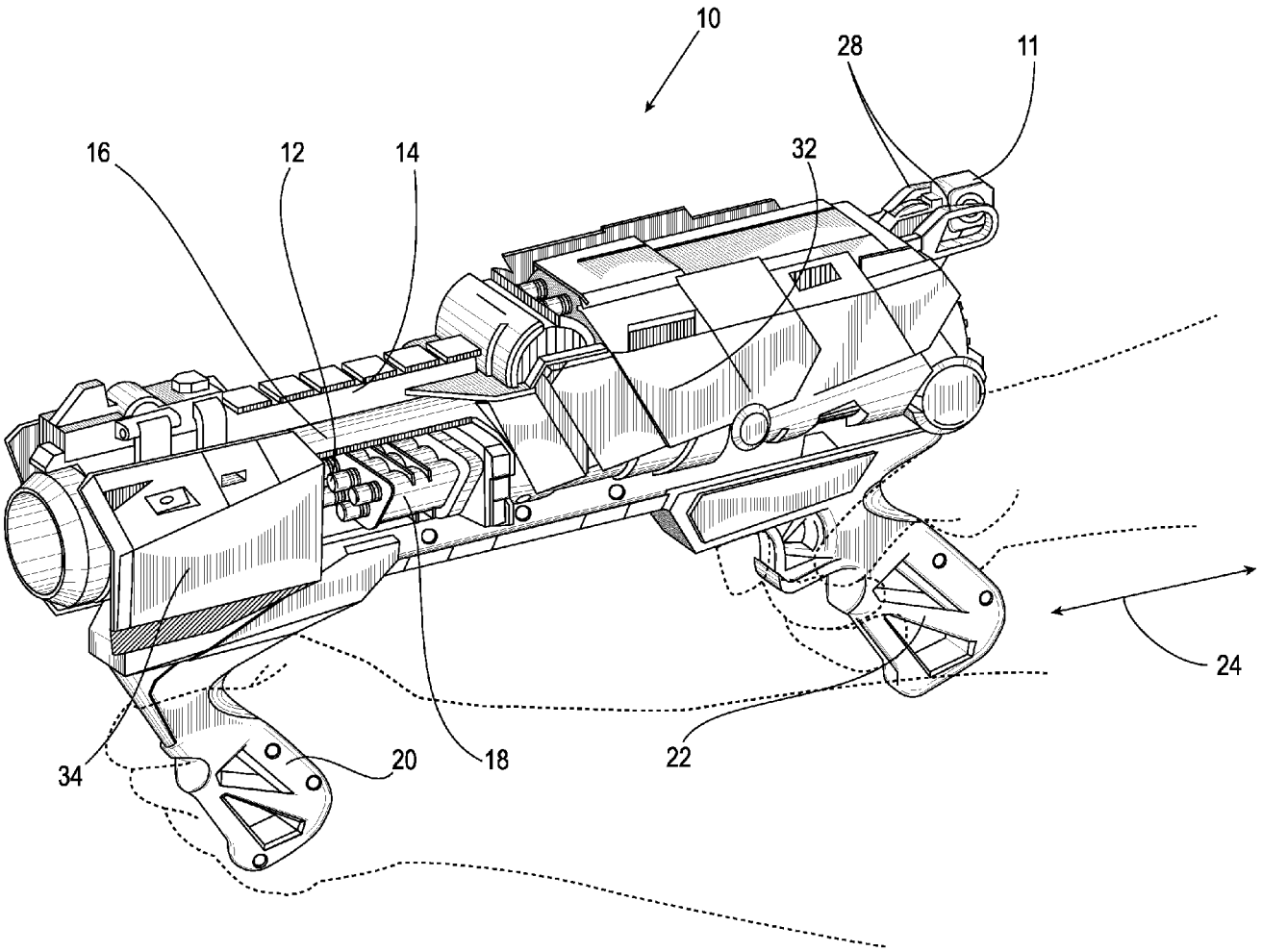
FIGS. 2A and 2B illustrate movement of the device from one operational position to another second operational position while in the first mode.
Figure 2B:
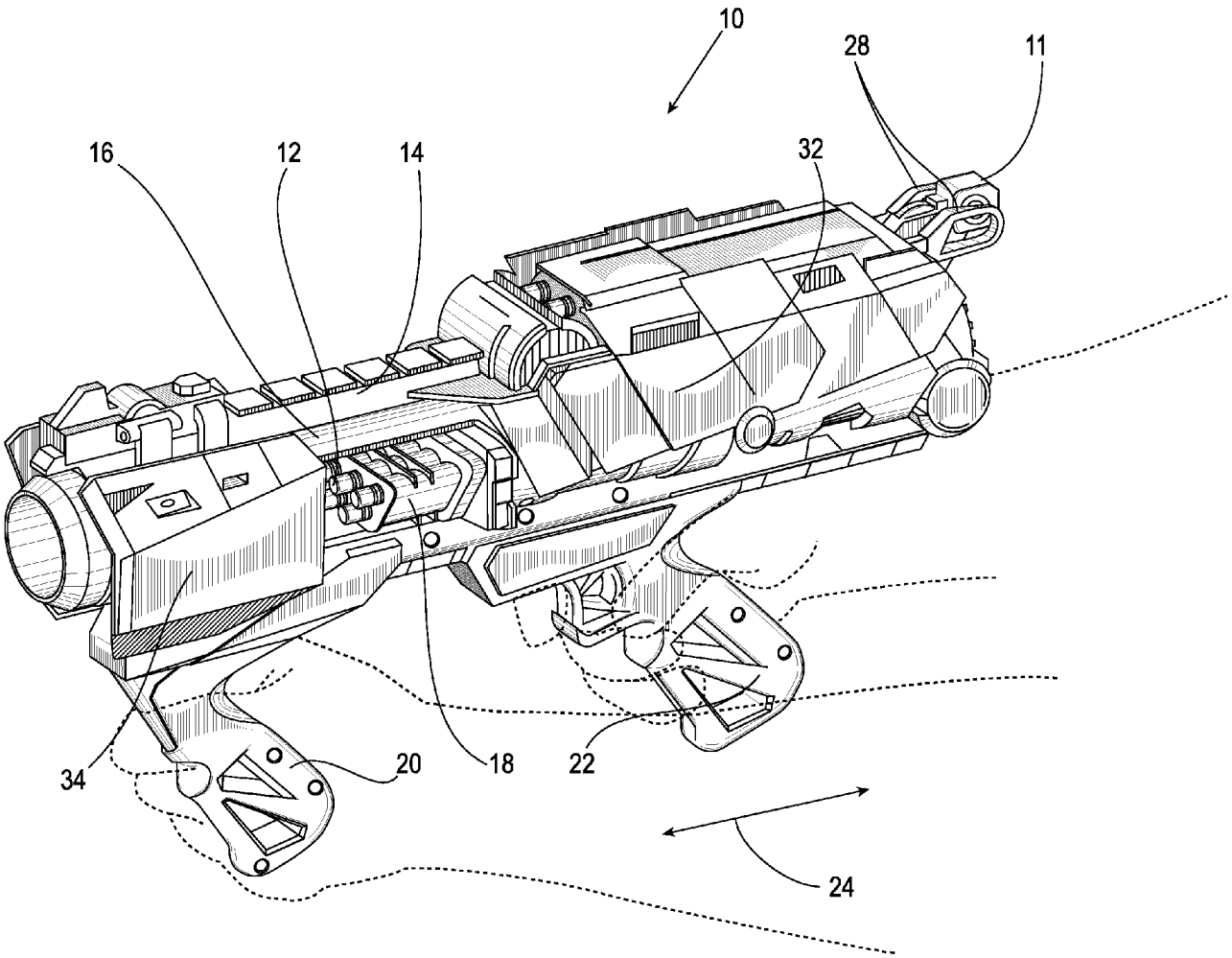
Figure 3A:
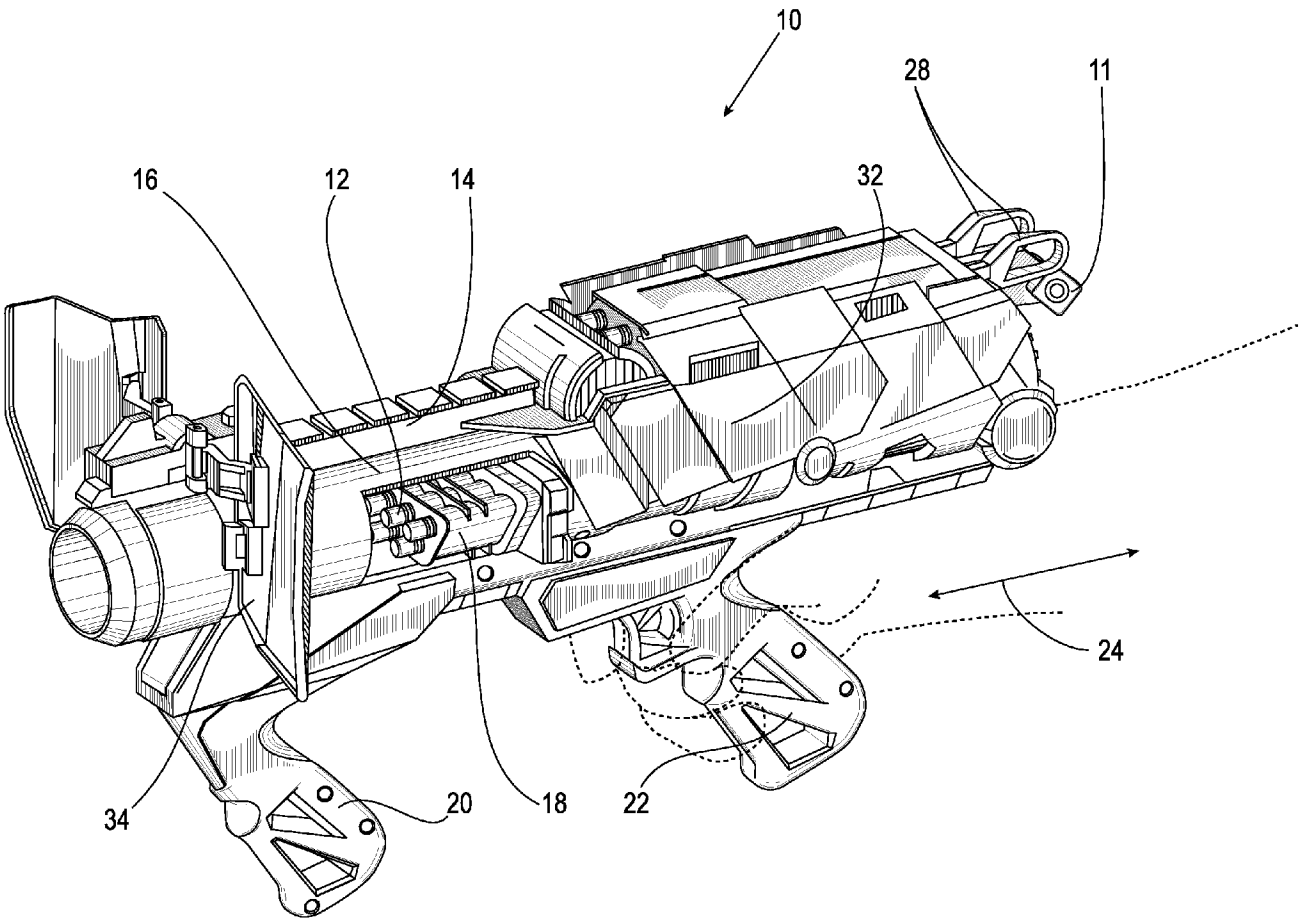
FIGS. 3A and 3B illustrate operation of the device in the second mode.
Figure 3B:
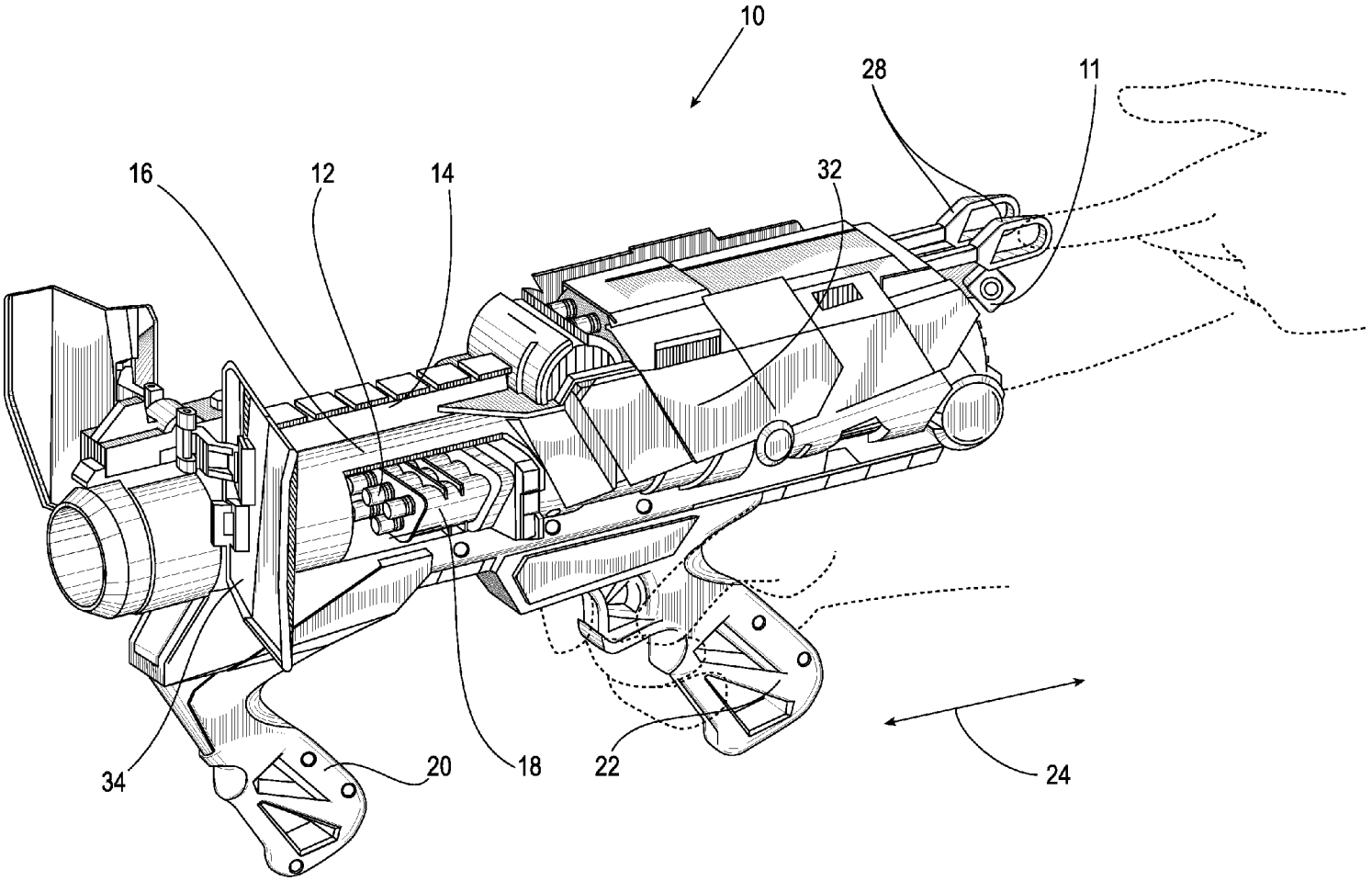

Although the drawings represent varied embodiments and features of the present invention, the drawings are not necessarily to scale and certain features may be exaggerated in order to illustrate and explain exemplary embodiments the present invention. The exemplification set forth herein illustrates several aspects of the invention, in one form, and such exemplification is not to be construed as limiting the scope of the invention in any manner.

DETAILED DESCRIPTION

Referring now to the FIGS., a toy, device, toy gun or apparatus 10 for launching a toy projectile 12 constructed in accordance with various non-limiting exemplary embodiments of the present invention is illustrated. In one embodiment, the toy projectile 12 is constructed in accordance with U.S. patent application Ser. No. 13/838,900 filed Mar. 15, 2013 the contents of which are also incorporated herein by reference thereto.

Toy, device, toy gun, launcher or apparatus 10, hereinafter referred to as toy or launcher 10, comprises a main housing 14. Toy 10 is a projectile launcher that can shoot toy projectiles 12 from different portions of the launcher or toy 10. In order to achieve this, the toy 10 has two modes of operation, which are selected by a mode switch 11 located proximate to a rear portion of the toy. Movement of the mode switch 11 allows a user to select between a first or second mode of operation through movement of the switch 11 between a first position and a second position.

Housing 14 includes a passageway 16 extending through the housing 14 that accommodates a magazine 18 containing one or more projectiles 12 and allows the magazine 18 to advance therethrough. Housing 14 also has a forward pistol grip portion or forward handle 20 and a second pistol grip portion or rearward handle 22. The second pistol grip portion 22 being movably or slidably mounted to the housing 14 for movement in the direction of arrows 24 between a first position (see at least FIGS. 1A, 1B, 3A, 3B and 4B) to a second position (see at least FIGS. 2A, 4A, 5A and 5B).

When the toy 10 is in a first mode of operation, projectiles 12 are launched through the main body or housing 14 of the launcher 10 each time the second pistol grip portion or rear handle 22 of the launcher 10 is moved rearward from the first position (see at least FIGS. 1A, 1B, 3A, 3B and 4B) to a second position (see at least FIGS. 2A, 4A, 5A and 5B) and back to the first position (see at least FIGS. 1A, 1B, 3A, 3B and 4B). Alternatively, projectiles can be launched merely by moving the second pistol grip portion or rear handle 22 of the launcher 10 between the first position the second position only once. Still further, any other movement of the second pistol grip portion or rear handle 22 in the directions of arrows 24 may be used to launch projectiles. This first mode of operation occurs when the mode switch 11 is in its upper position illustrated in at least FIGS. 1A, 2A, 2B, 5A and 5B. In one embodiment, the projectiles may be sequentially launched from the magazine 18 as the second pistol grip portion or rear handle 22 is moved the directions of arrows 24.

Figure 4A:
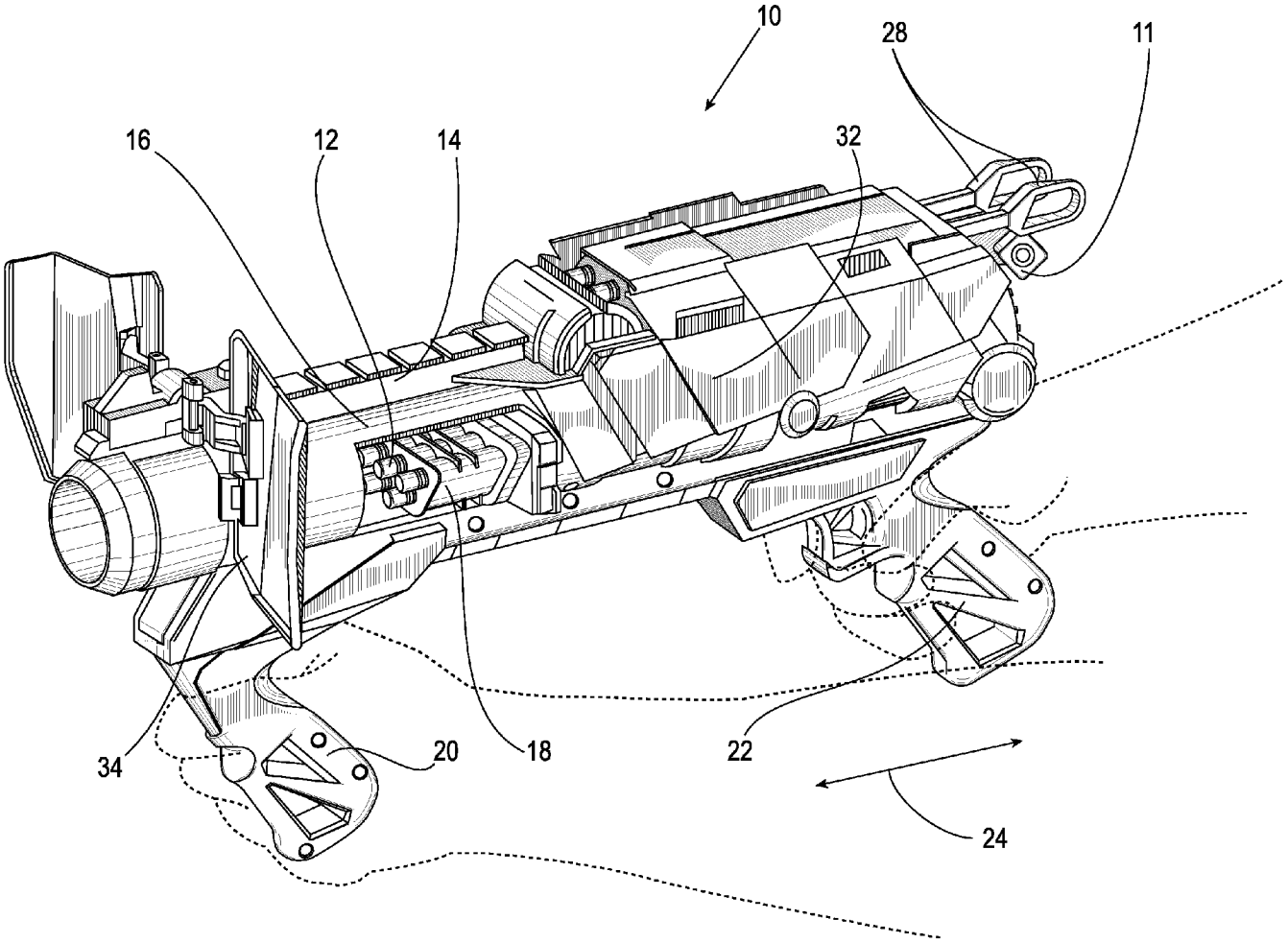
FIGS. 4A and 4B illustrate movement of the device from a one operational position to another operational position while in the second mode.
Figure 4B:
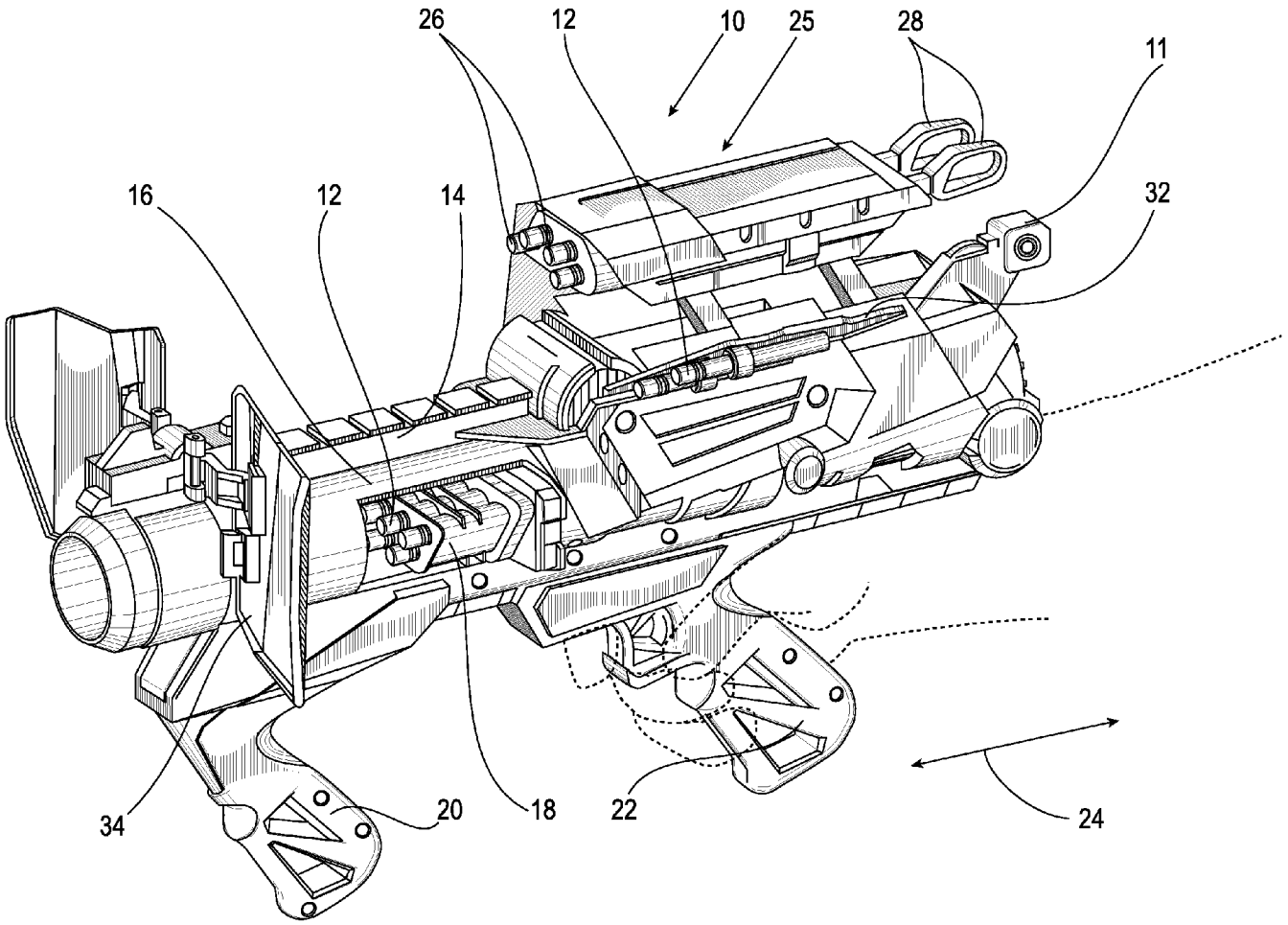
Figure 5A:
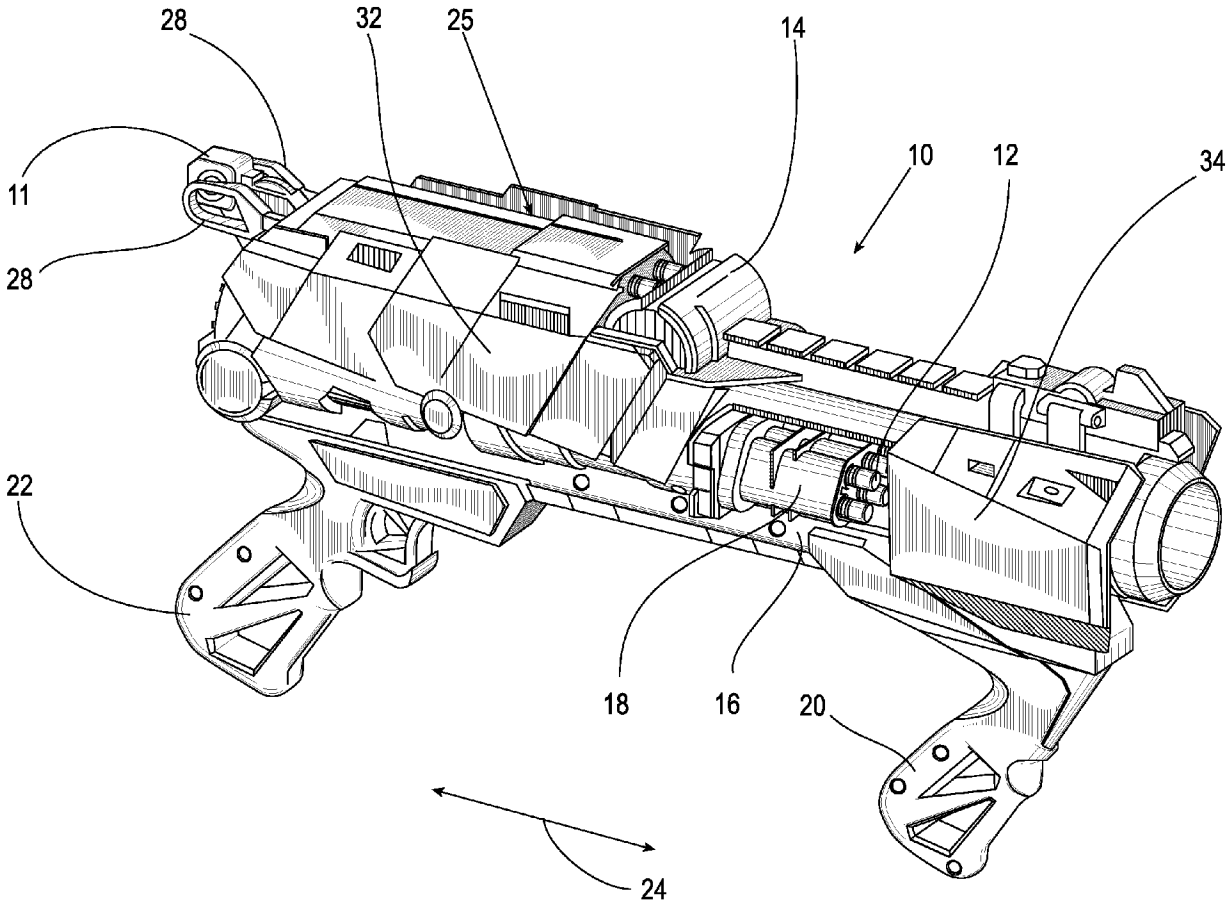
FIG. 5A is a perspective view of the device in a first configuration in the first mode.
Figure 5B:
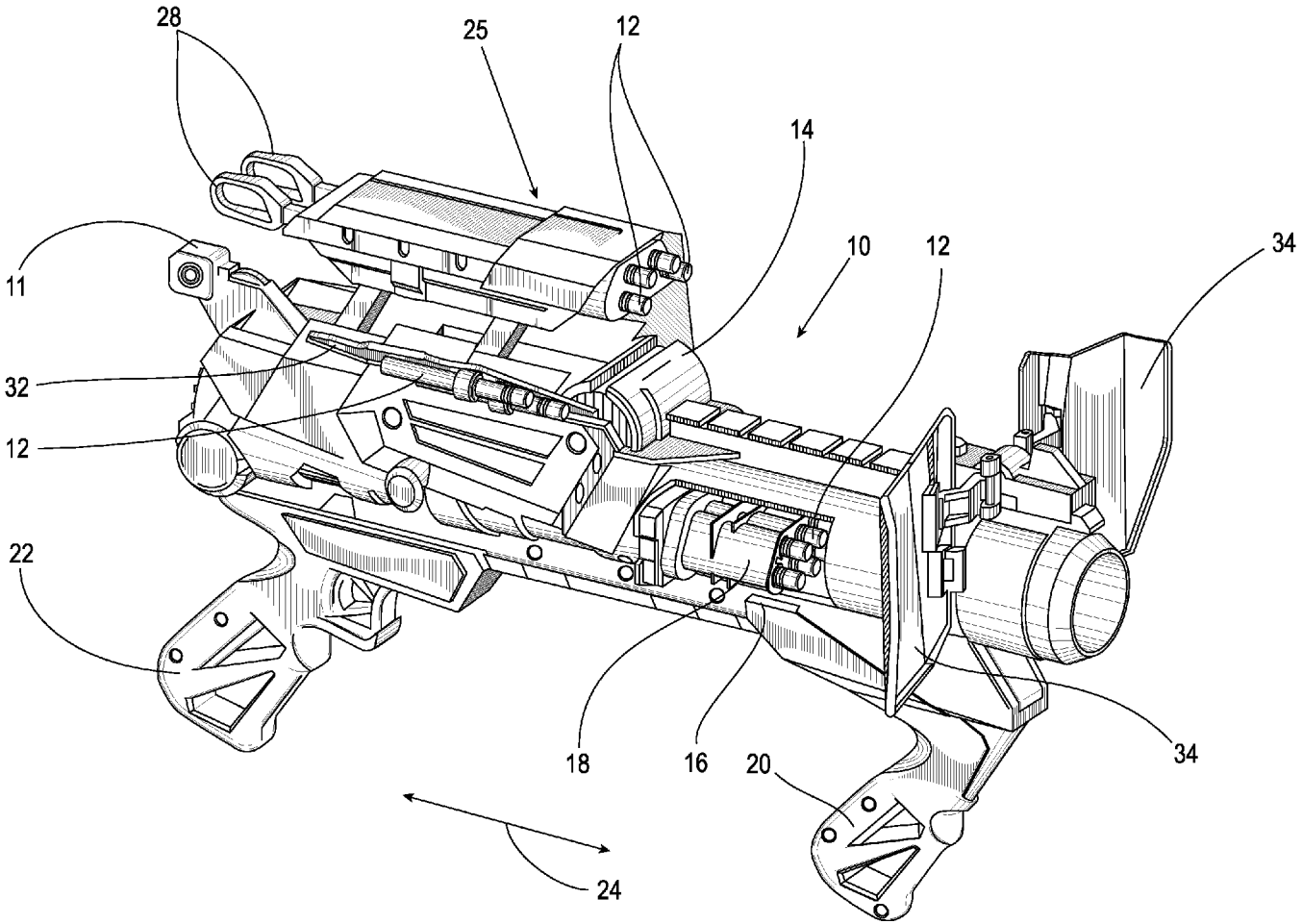
FIG. 5B is a perspective view of the device in a second configuration in the second mode.

When a user moves the mode switch 11 down to its lower position or second position, the operation of the launcher 10 changes such that as the second pistol grip portion or rear handle 22 of the launcher 10 is moved rearward from the first position (see at least FIGS. 1A, 1B, 3A, 3B and 4B) to a second position (see at least FIGS. 2A, 4A, 5A and 5B) and back to the first position (see at least FIGS. 1A, 1B, 3A, 3B and 4B) a supplemental projectile launcher 25 is moved from a stowed position (See at least FIGS. 1A-4A and 5A) to a deployed position (See at least FIGS. 4B and 5B). As mentioned above and in various alternative embodiments any movement of the second pistol grip portion or rear handle 22 in the direction of arrows 24 may be used to operate the toy 10 in the second mode of operation.

During this mode of operation projectiles 12 are launched from additional launchers 26 that are movably coupled to the main body 14 of the toy 10. In this second mode, when toy projectiles 12 are inserted into the launching chambers of the additional launchers 26, and a respective spring biased plunger 28 of each launcher is pulled rearward from a first position (See at least FIG. 3A) to a second position (See at least FIG. 3B) to load or cock a launcher 26, the movement of the lower rear handle or second pistol grip portion 22 rearward and then forward results in the additional launchers 26 popping or rising up from the stowed position into the deployed position and then launching the projectiles 12 therefrom by releasing a spring biasing force configured to draw the plungers from the uncocked position to the cocked position. In other words, the plungers are configured to slidably move within a piston chamber and a piston portion of the plunger applies compressed air towards the projectile 12 in order to launch the projectiles 12 from the launchers 26 as they move from the stowed position to the deployed position. One non-limiting means for achieving this is to have a releasable feature configured to retain the plungers in the cocked position and once the launchers are moved from the stowed position to the deployed position, the releasable feature allows the plungers to be released and launch the projectiles from the launchers 26.

In one embodiment, the launchers 26 are secured to or comprise a portion of a moveable platform 30 that is spring biased into the deployed position and a releasable feature retains the platform 30 in the stowed position against the spring biasing force and when the toy is in the second mode of operation and the rear handle or second pistol grip portion is manipulated in the appropriate directions the platform 30 will spring up and the projectiles 12 will be launched from the launchers 26.

After the projectiles 12 are launched, a user can manually move the additional launchers 26 and platform 30 downwardly to their lowered positions proximate to the main body of the housing 14.

Also shown in at least FIGS. 4A and 4B is that the toy 10 has a pair of deployable portions 32, which are capable of moving from a stowed position (see at least FIG. 4A) to a deployed position (See at least FIG. 4B). As with the launchers 26 and/or platform 30, the deployable portions 32 may also be spring biased into the deployed position and a releasable feature retains them in the stowed position against the spring biasing force and when the toy 10 is in the second mode of operation and the rear handle or second pistol grip portion 22 is manipulated in the appropriate directions the deployable portions 32 will spring outward into the deployed position at the same time projectile launchers 26 and platform 30 moves from the stowed position to the deployed position. Also shown is that an underside of deployable portions 32 may be configured to releaseably store additional projectiles 12 that are now accessible when in the deployed position.

The toy or launcher 10 also has a pair of deployable shield portions 34 that are located at a forward end of the launcher 10 and can be manipulated into a deployed position (See at least FIGS. 3A, 3B, 4A, 4B and 5B) from a stowed position (See at least FIGS. 1A-2B and 5A). Operation of shield portions 34 can be manual or as in the above embodiments, tied into movement of the rear handle or second pistol grip portion 22 in the appropriate directions such that a release mechanism is actuated and a spring biasing force is released to move the shield portions 34 into the deployed position. The location of the shield portions 34 at the forward end of the toy 10 will provide a user protection from projectiles 12 being launched at them from another launcher. This would be helpful should the toy be used in a game of tag wherein the projectiles 12 are used to tag another player and thus shield portions 34 protect the operator or toy 10.

Accordingly, movement or operation of the rear handle or second pistol grip portion 22 in the appropriate directions operates various components of the toy 10. For example, movement of the rear handle or second pistol grip portion 22 will in one embodiment, cause compressed air or fluid to be released to launch a projectile and/or transferred to an operating device or engine in order to advance a magazine 18 in order to load or advance projectiles 12 into alignment with cylinder of the toy 10 that launches the projectiles 12.

Figure 6:
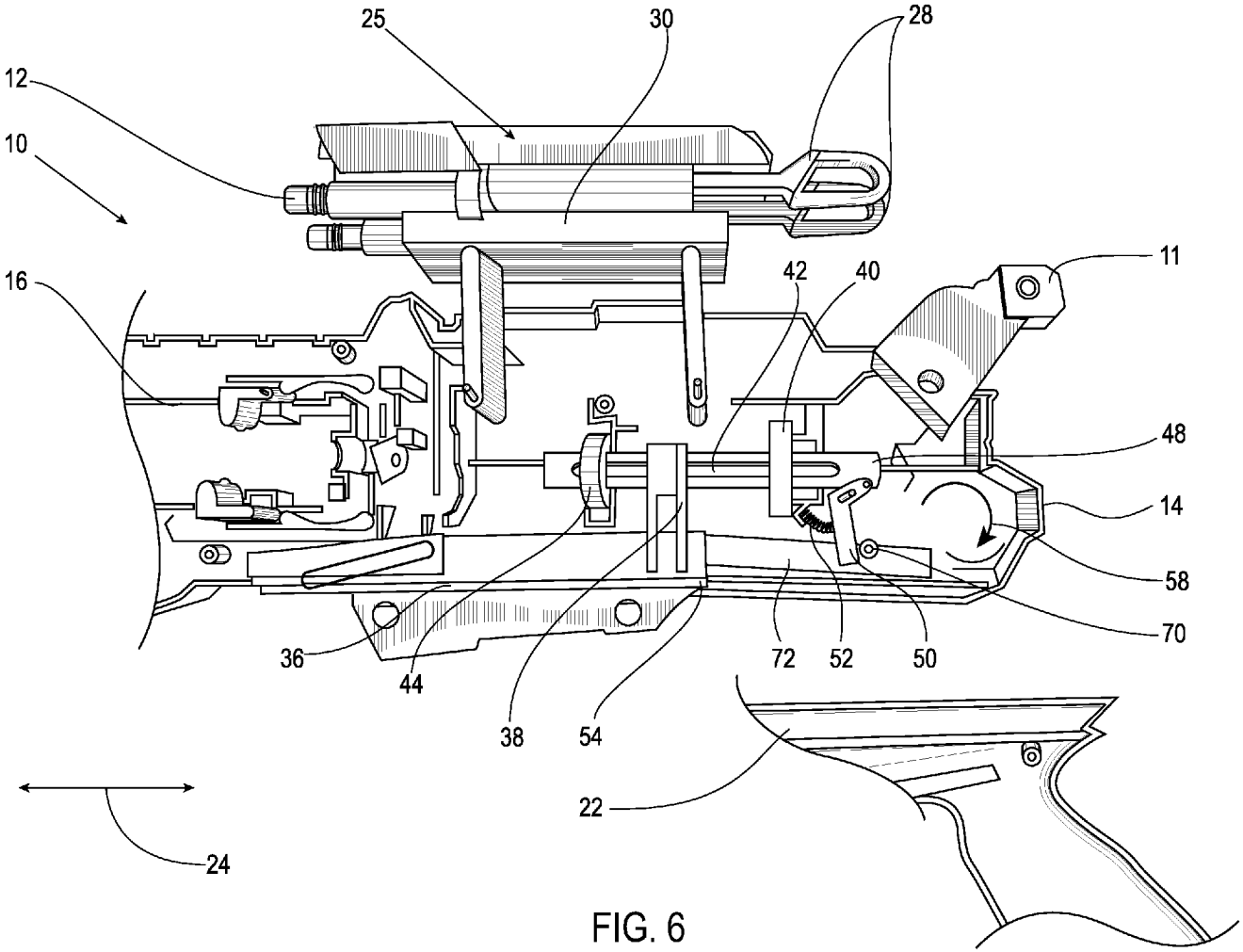
FIGS. 6 and 7 are partial views of interior components of the device, wherein outer portions have been removed.
Figure 7:
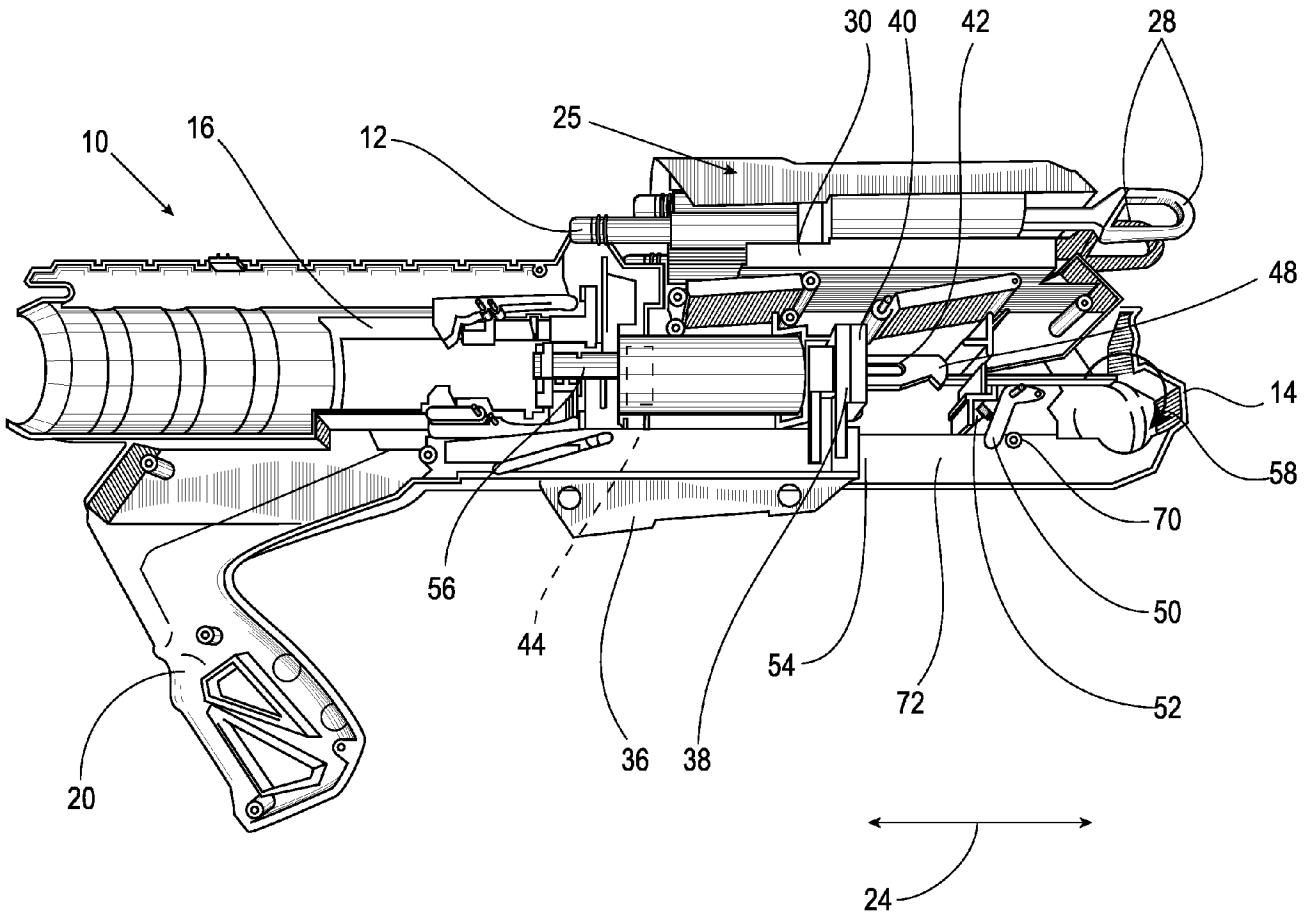

Referring now to FIGS. 6 and 7 internal components of the toy 10 are illustrated. Here portions of the housing 14 and internal components are removed to illustrate some internal components. In one embodiment, the rear handle or second pistol grip portion 22 is secured to a member 36 slidably secured to the housing 14. Member 36 moves as the rear handle or second pistol grip portion 22 is moved in the directions of arrows 24. As member 36 moves rearward, a feature 38 contacts a feature 40 of a plunger 42 operatively coupled to a piston 44 slidably received within a cylinder 46. This rearward movement will cause a hook 48 of plunger 42 to be captured by a pivotally mounted release mechanism 50 that is spring biased into a first or release position by a spring 52. As member 36 moves rearward a feature 54 contacts the release mechanism 50 and rotates it into a retaining position (See at least FIG. 6) wherein mechanism 50 contacts hook 48 and retains plunger 42 in the extended or cocked position (see at least FIG. 6). In this position the piston 44 is moved rearward in cylinder 46 against a spring biasing force such that once release mechanism 50 is actuated (e.g., hook 48 is released) the spring biasing force will push piston 44 forward and compressed air in cylinder 46 will be directed into a nozzle 56 and thus a projectile 12 aligned therewith will be launched therefrom. It is understood that in one non-limiting embodiment, a dart or projectile detection mechanism or safety mechanism may be incorporated into toy 10.

One non-limiting method of actuating release mechanism 50 is to rotate it in the direction of arrow 58 by contacting one portion of mechanism 50 with a feature 70 that is located on a moveable member 72 also capable of moving in the direction of arrows 24 as rear handle or second pistol grip portion 22 is moved in the directions of arrows 24. Accordingly and as mentioned above, this movement will cause different types of operation of the toy or launcher 10 depending upon the position of mode selection switch 11. For example and in one non-limiting embodiment, movement of the switch 11 into one position will prevent hook 48 from being retained by release mechanism 50 and thus the movement of the rear handle or second pistol grip portion 22 in the directions of arrows 24 will not cause piston 44 to launch projectiles 12 however, this movement will cause other operations such as the deployment of the projectile launchers 26 of the supplemental projectile launcher 25 and/or deployable members 32, which may be achieved by feature 38 contacting a release mechanism or mechanisms associated with the projectile launchers 26 and/or deployable members 32. Similarly and as mentioned above, when the supplemental projectile launcher 25 is moved from a stowed position to the deployed position, the spring biased plungers 28 are released from their cocked positions and projectiles 12 are launched therefrom.

Accordingly, a toy or launcher 10 is configured to launch projectiles 12 from different portions of the launcher 10. The toy 10 has two modes of operation, which are selected by a mode switch 11 located on a portion of the toy 10.

As used herein, the terms "first," "second,"- and the like, herein do not denote any order, quantity, or importance, but rather are used to distinguish one element from another, and the terms "a" and "an" herein do not denote a limitation of quantity, but rather denote the presence of at least one of the referenced item. In addition, it is noted that the terms "bottom" and "top" are used herein, unless otherwise noted, merely for convenience of description, and are not limited to any one position or spatial orientation.

The modifier "about" used in connection with a quantity is inclusive of the stated value and has the meaning dictated by the context (e.g., includes the degree of error associated with measurement of the particular quantity).

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention.

What is claimed is:

1. A toy configured to operate in two modes of operation wherein projectiles are launched from different portions of the toy depending upon the mode of operation of the toy, the toy comprising:

a housing, having a user-actuable launch mechanism movably mounted to the housing for movement between a first position and a second position;

a mode selector switch movably mounted to the housing for movement from a first mode selector position to a second mode selector position;

a primary projectile launcher mounted to the housing;

a secondary projectile launcher movably mounted to the housing and movable from a first launcher position within the housing to a second launcher position outside the housing;

wherein movement of the user-actuable launch mechanism between the first position and the second position launches a projectile from the primary projectile launcher when the mode selector switch is in the first mode selector position; and wherein movement of the user-actuable launch mechanism between the first position and the second position launches a projectile from the secondary projectile launcher in the second launcher position when the mode selector switch is in the second mode selector position.

2. The toy as in claim 1, wherein the primary projectile launcher is located proximate a front end of the housing.

3. The toy as in claim 2, wherein the secondary projectile launcher is spaced from the front end of the housing.

4. The toy as in claim 3, wherein the secondary projectile launcher is spring biased into the second launcher position.

5. The toy as in claim 4, wherein the housing has a passageway extending through the housing that slidably receives a magazine containing a plurality of projectiles.

6. The toy as in claim 5, wherein the plurality of projectiles are launched from the magazine when the mode selector switch is in the first mode selector position and the user-actuable launch mechanism is moved between the first position and the second position.

7. The toy as in claim 1, wherein the secondary projectile launcher is movably secured to a top portion of the housing for movement between the first launcher position and the second launcher position and wherein the secondary projectile launcher is spring biased into the second launcher position.

8. The toy as in claim 7, wherein the secondary projectile launcher further comprises a pair of projectile launchers each having a spring biased plunger that is released when the secondary projectile launcher moves from the first launcher position to the second launcher position.

9. The toy as in claim 1, wherein the housing has a passageway extending through the housing that slidably receives a magazine containing a plurality of projectiles, wherein the plurality of projectiles are sequentially launched from the magazine when the mode selector switch is in the first mode selector position and the user-actuable launch mechanism is moved between the first position and the second position.

10. The toy as in claim 1, wherein the housing further comprises a pair of deployable portions movably secured thereto that move outwardly and away from the housing from a stowed position to a deployed position, wherein the pair of deployable portions move from the stowed position to the deployed position as the user-actuable launch mechanism is moved between the first position and the second position.

11. The toy as in claim 10, wherein an underside of the pair of deployable portions is configured to removably receive projectiles that are only accessible when the pair of deployable portions are in the deployed position and wherein each one of the pair of deployable portions is located on opposite sides of the housing with respect to each other.

12. The toy as in claim 11, wherein the housing further comprises a pair of deployable shield portions movably secured thereto that move outwardly and away from the housing from a stowed shield position to a deployed shield position, wherein the pair of deployable shield portions move from the stowed shield position to the deployed shield position as the user-actuable launch mechanism is moved between the first position and the second position, wherein each one of the pair of deployable shield portions is located on opposite sides of the housing with respect to each other and wherein the pair of deployable shield portions are positioned forward on the housing with respect to the pair of deployable portions.

13. The toy as in claim 1, wherein the housing further comprises a pair of deployable portions movably secured thereto that move outwardly and away from the housing from a stowed position to a deployed position, wherein the pair of deployable portions move from the stowed positon to the deployed position as the user-actuable launch mechanism is moved between the first position and the second position and wherein the housing further comprises a pair of deployable shield portions movably secured thereto that move from a stowed shield position to a deployed shield position, wherein each one of the pair of deployable shield portions is located on opposite sides of the housing with respect to each other and wherein the pair of deployable shield portions are positioned forward on the housing with respect to the pair of deployable portions.

14. A toy, comprising:

a housing;

a user-actuable launch mechanism movably mounted to the housing for movement between a first position and a second position;

a mode selector switch movably mounted to the housing for movement from a first mode selector position to a second mode selector position;

a primary projectile launcher mounted to the housing;

a secondary projectile launcher movably mounted to the housing and movable from a first launcher position with respect to the housing to a second launcher position with respect to the housing, the second launcher position being further away from the housing than the first launcher position;

wherein movement of the user-actuable launch mechanism between the first position and the second position launches a projectile from the primary projectile launcher when the mode selector switch is in the first mode selector position; and wherein movement of the user-actuable launch mechanism between the first position and the second position launches a projectile from the secondary projectile launcher in the second launcher position when the mode selector switch is in the second mode selector position.

15. The toy as in claim 14, wherein the secondary projectile launcher moves between the first launcher position and the second launcher position with respect to the housing as the user-actuable launch mechanism is between the first position and the second position with respect to the housing.

16. The toy as in claim 15, wherein the secondary projectile launcher is spring biased into the second launcher position and wherein the housing has a passageway extending through the housing that slidably receives a magazine containing a plurality of projectiles, wherein the plurality of projectiles are launched from the magazine when the mode selector switch is in the first mode selector position and the user-actuable launch mechanism is moved between the first position and the second position.

17. The toy as in claim 15, wherein the secondary projectile launcher further comprises a pair of spring biased projectile launchers each having a spring biased plunger that is released when the secondary projectile launcher moves from the first launcher position to the second launcher position.

18. The toy as in claim 14, wherein the housing further comprises a pair of deployable portions movably secured thereto that move outwardly and away from the housing from a stowed position to a deployed position, wherein the pair of deployable portions move from the stowed position to the deployed position as the user-actuable launch mechanism is moved between the first position and the second position.

19. The toy as in claim 18, wherein the housing further comprises a pair of deployable shield portions movably secured thereto that move outwardly and away from the housing from a stowed shield position to a deployed shield position, wherein the pair of deployable shield portions move from the stowed shield position to the deployed shield position as the user-actuable launch mechanism is moved between the first position and the second position, wherein each one of the pair of deployable shield portions is located on opposite sides of the housing with respect to each other and wherein the pair of deployable shield portions are positioned forward on the housing with respect to the pair of deployable portions.

20. The toy as in claim 14, wherein the housing further comprises a pair of deployable shield portions movably secured thereto that move outwardly and away from the housing from a stowed shield position to a deployed shield position, the deployed shield position being substantially perpendicular to a direction of launch of a projectile, wherein the pair of deployable shield portions move from the stowed shield position to the deployed shield position as the user-actuable launch mechanism is moved between the first position and the second position.

* * * * *